US011458644B2

(12) United States Patent
Erndt

(10) Patent No.: US 11,458,644 B2
(45) Date of Patent: Oct. 4, 2022

(54) ELECTRIC SHAVER

(71) Applicant: Braun GmbH, Kronberg (DE)

(72) Inventor: Andreas Erndt, Kelkheim (DE)

(73) Assignee: Braun GMBH, Kronberg (DE)

( * ) Notice: Subject to any disclaimer, the term of this patent is extended or adjusted under 35 U.S.C. 154(b) by 0 days.

(21) Appl. No.: 16/364,783

(22) Filed: Mar. 26, 2019

(65) Prior Publication Data

US 2019/0299438 A1 Oct. 3, 2019

(30) Foreign Application Priority Data

Mar. 29, 2018 (EP) ..... 18164822

(51) Int. Cl.
*B26B 19/38* (2006.01)
*B26B 19/12* (2006.01)
*B26B 19/16* (2006.01)

(52) U.S. Cl.
CPC ..... *B26B 19/3866* (2013.01); *B26B 19/12* (2013.01); *B26B 19/16* (2013.01)

(58) Field of Classification Search
CPC ..... B26B 19/3866; F16J 15/02–025
See application file for complete search history.

(56) References Cited

U.S. PATENT DOCUMENTS 3,748,371 A 7/1973 Krook et al.
3,950,847 A * 4/1976 Duda ..... B26B 19/10 30/34.1
4,426,776 A * 1/1984 Kakumoto ..... B26B 19/38 30/41
4,604,800 A * 8/1986 Yamamoto ..... B26B 19/14 30/41
4,628,607 A * 12/1986 Bertram ..... B26B 19/282 30/43.92
4,910,869 A * 3/1990 Labrijn ..... B26B 19/14 30/43.6
5,050,300 A * 9/1991 Miska ..... B26B 19/28 30/34.1
5,579,581 A 12/1996 Melton
(Continued)

FOREIGN PATENT DOCUMENTS

CN 106514732 A 3/2017
CN 207139863 U 3/2018
(Continued)

OTHER PUBLICATIONS

Daniel Klinteback; Extended European Search Report; European Application No. 18164822.1; dated Oct. 18, 2018; European Patent Office; Munich, Germany.
(Continued)

*Primary Examiner* — Evan H MacFarlane
(74) *Attorney, Agent, or Firm* — Gerd Zetterer; Kevin C. Johnson

(57) ABSTRACT

An electric shaver, comprising an elongated housing receiving an electric motor and/or an electric power source, a working head attached to said housing, wherein said housing includes an elongated base element and a cover element closing said base element and surrounding a connection connecting said electric motor and/or said electric power source to said working head, wherein said cover element is sealed to said base element and/or to said connection by at least one seal.

6 Claims, 7 Drawing Sheets

(56) References Cited

U.S. PATENT DOCUMENTS

| | | | | |
|---|---|---|---|---|
| 5,704,126 | A * | 1/1998 | Franke | B26B 19/046 30/34.1 |
| 7,841,090 | B2 * | 11/2010 | Eichhorn | B26B 19/048 30/346.51 |
| 2002/0195455 | A1 * | 12/2002 | Takahashi | B65D 53/02 220/806 |
| 2006/0156551 | A1 * | 7/2006 | Khubani | B26B 19/3893 30/130 |
| 2006/0288581 | A1 * | 12/2006 | Rogatschnig | B26B 19/10 30/34.1 |
| 2008/0020619 | A1 * | 1/2008 | Shigeta | B26B 19/3833 439/271 |
| 2009/0025229 | A1 * | 1/2009 | Kappes | B26B 19/048 30/43.92 |
| 2010/0325892 | A1 * | 12/2010 | Nuber | B26B 19/265 30/34.1 |
| 2016/0156244 | A1 * | 6/2016 | Komori | B26B 19/3866 310/17 |
| 2018/0020819 | A1 * | 1/2018 | Steckling | A46B 15/0008 15/167.1 |
| 2019/0061182 | A1 * | 2/2019 | Yan | C08L 83/04 |
| 2019/0077957 | A1 * | 3/2019 | Yamada | C08L 23/02 |

FOREIGN PATENT DOCUMENTS

| | | | | |
|---|---|---|---|---|
| DE | 34 15 124 | A1 * | 10/1985 | B26B 19/14 |
| DE | 202015103618 | U1 | 9/2015 | |
| FR | 1391957 | | 3/1965 | |
| GB | 811207 | | 4/1959 | |
| JP | S60-167262 | U | 11/1985 | |
| JP | S60-222083 | A | 11/1985 | |
| JP | S63-21240 | Y2 | 6/1988 | |
| JP | H 10-151285 | * | 6/1998 | |
| JP | H10151285 | A | 6/1998 | |
| JP | 2006192109 | A | 7/2006 | |
| JP | 2008237813 | A | 10/2008 | |
| JP | 4539515 | B2 | 9/2010 | |
| WO | 2018060875 | A1 | 4/2018 | |

OTHER PUBLICATIONS

Search Report; Chinese Patent Application No. 2019102401644; dated Aug. 13, 2020; CNIPA; Beijing, China.

* cited by examiner (b)

(a)

(b)

(a)

ELECTRIC SHAVER

FIELD OF THE INVENTION

The present invention relates to an electric shaver, in particular an electric shaver, comprising an elongated housing receiving an electric motor and/or an electric power source, a working head attached to said housing, wherein said housing includes an elongated base element and a cover element closing said base element and surrounding a connection connecting said electric motor and/or said electric power source to said working head, wherein said cover element is sealed to said base element and/or to said connection by at least one seal.

BACKGROUND OF THE INVENTION

Electric shavers and other hair removal devices such as epilators usually have one or more cutter elements driven by an electric drive unit in an oscillating manner where the cutter elements reciprocate under a shear foil, wherein such cutter elements or undercutters may have an elongated shape and may reciprocate along their longitudinal axis. Other types of electric shavers use rotatory cutter elements which may be driven in an oscillating or a continuous manner. Said electric drive unit may include an electric motor or a magnetic-type linear motor, wherein the drive unit may include a drive train having elements such as an elongated drive transmitter for transmitting the driving motion of the motor to the cutter element, wherein said motor may be received within the handle portion of the shaver.

When accommodating the motor in the handle, the drive train connecting the motor in the handle to the cutter units in the shaver head need to extend through the housing and penetrate a housing wall so as to project to and drive the cutter elements of the shaver head. The drive train often includes a rotatorily oscillating shaft extending through a front end of said housing to project towards the shaver head, wherein the oscillating shaft, at its end outside the housing, may drive a pair of pins which in turn drive the cutter elements. Due to the oscillating and/or rotatory and/or linearly pushing along the longitudinal shaft axis movement of the shaft, the seal for sealing the housing at the opening through which the shaft extends, needs to be elastic and/or to allow said movement, but nevertheless should prevent liquids or moisture from entering into the housing.

On the other hand, when the motor is accommodated within the shaver head, no such drive train extending from the housing into the shaver head is necessary. Nevertheless, usually an electric connection from the power source accommodated in the housing extends into the shaver head to supply power from said electric power source to the motor. Such power source may be an electric power storage such as a battery or an accumulator. Sealing such electric connection is easier as there are no oscillating movements, but nevertheless sealing is necessary.

Furthermore, the housing accommodating the electric motor and/or electric power source often includes an elongated base element closed by a cover element to allow for mounting and accommodating the electronic components inside the housing. As the housing should nevertheless form a sealed container for protecting the electric components from liquids and moisture, a seal is provided between the base element and the cover element, wherein such seal may include a sealing ring extending between surfaces of the base element and the cover element facing each other.

Generally, mounting of such sealing elements is prone to faults and mistakes. For example, when positioning the sealing element at a slightly wrong position, water or moisture may enter the housing. In addition, the multiple sealing surfaces may not be completely water proof due to tolerances or material defects. Furthermore, logistics of manufacturing and assembling the device is complicated as lots of parts need to be provided at the right position at the right time as various seals of different configurations are necessary.

Furthermore, due to ergonomic handling reasons it is sometimes desired to have the shaver head and thus the aforementioned oscillating shaft tilted relative to the longitudinal axis of the housing. To allow for such tilted arrangement of the drive train and easy assembling of the components, it is sometimes desired to have the interface between the elongated base element of the housing and the cover element thereof in a plane inclined to the longitudinal axis of the housing at an acute angle. In other words, the end surface of the cover element to be connected with the base element extends in a plane substantially perpendicular to the longitudinal axis of the drive train, in particular the aforementioned rotatorily oscillating shaft to allow for easy mounting of the drive train into the cover element. Due to the tilted arrangement of said drive train, however, the end surface of the cover element does no longer extend perpendicular to the longitudinal axis of the housing, but at an acute angle. Positioning a sealing ring at said tilted interface is even more difficult.

US 2009/0025229 A1 discloses a drive unit for the cutter elements of an electric shaver, wherein the drive unit includes transmitter pins extending from the shaver housing towards the shaver head, wherein the oscillating driving movements of said transmitter pins are applied onto the cutter elements via an oscillatory bridge supported for oscillatory reciprocation in the shaver head, wherein said oscillatory bridge includes yielding coupling arms so as to allow for adjusting movements of the cutter elements. A similar transmission architecture is known from U.S. Pat. No. 7,841,090 B2.

Further electric shavers allowing for adapting movements of the cutter elements are known from U.S. Pat. No. 3,748,371 B, FR 1391957 A, GB 811,207 B and U.S. Pat. No. 5,704,126 B.

SUMMARY OF THE INVENTION

It is an objective underlying the present invention to provide for an improved electric shaver such as an electric shaver avoiding at least one of the disadvantages of the prior art and/or further developing the existing solutions.

A more particular objective underlying the invention is to provide for cost-sensitive, easy manufacturing of electric shavers sufficiently sealed against liquids.

A further objective underlying the invention is to provide for an improved shaver having a sealed container housing for accommodating electric components such as an electric motor and/or an electric power source, wherein the sealing is providing for sufficient protection against liquids and/or moisture and allows for easy manufacturing and assembling.

More particularly, an objective underlying the present invention is to achieve an improved sealing of the housing providing for reliably sealing even when there are tolerances in shape and/or dimensions of the housing elements to be connected and/or variations in the mounting forces pressing the housing elements against each other due to tolerances and/or mistakes in the assembling process.

To achieve at least one of the aforementioned objectives, it is suggested to provide for a seal which does no longer form a separate element, but is an integral portion of one of the housing elements. More particularly, the cover element for closing the base element of the housing, and said at least one seal may form an integral one-piece structure so that the seal is automatically mounted when assembling the electric shaver, more particularly when assembling the housing elements to each other and/or said cover element to the connection, i.e., a shaft, extending from the housing's interior through said cover element to the working head of the device. According to an aspect, the seal is integrally molded onto said cover element so that said seal and said cover element form an integral one-piece structure made from a soft-material component forming the seal and a hard-material component forming the cover element. Using a two-components molding process for manufacturing the cover element together with the seal allows for easy manufacturing and precise positioning of the seal relative to the cover element and thus, relative to the housing.

The seal may be formed from silicone. The cover element and/or the base element of the housing may be formed from polybutylene terephthalate (PBT). Other combinations of soft and hard materials are possible.

According to a further aspect, the aforementioned seal may comprise a first sealing element forming an axial seal sandwiched between the cover element and the base element of the housing under axial pressure substantially parallel to a longitudinal axis of the elongated housing. Such axial sealing element with axially exerted sealing forces allows for greater freedom in design of the interface between the cover element and the base element, but nevertheless provides for excellent sealing even when there are tolerances and/or variations in mounting forces.

According to a still further aspect, the seal may include a second sealing element forming a sleeve surrounding a rotatorily oscillating shaft extending through said cover element, wherein said sleeve-like second sealing element is, at one end thereof, fixedly connected to the cover element and, at another end, fixedly connected to said shaft to oscillate therewith, wherein the second sealing element is configured to twist and/or compensate rotatory oscillation of the shaft in an elastic manner.

These and other advantages become more apparent from the following description giving reference to the drawings and possible examples.

DETAILED DESCRIPTION OF THE INVENTION

Figure 1:
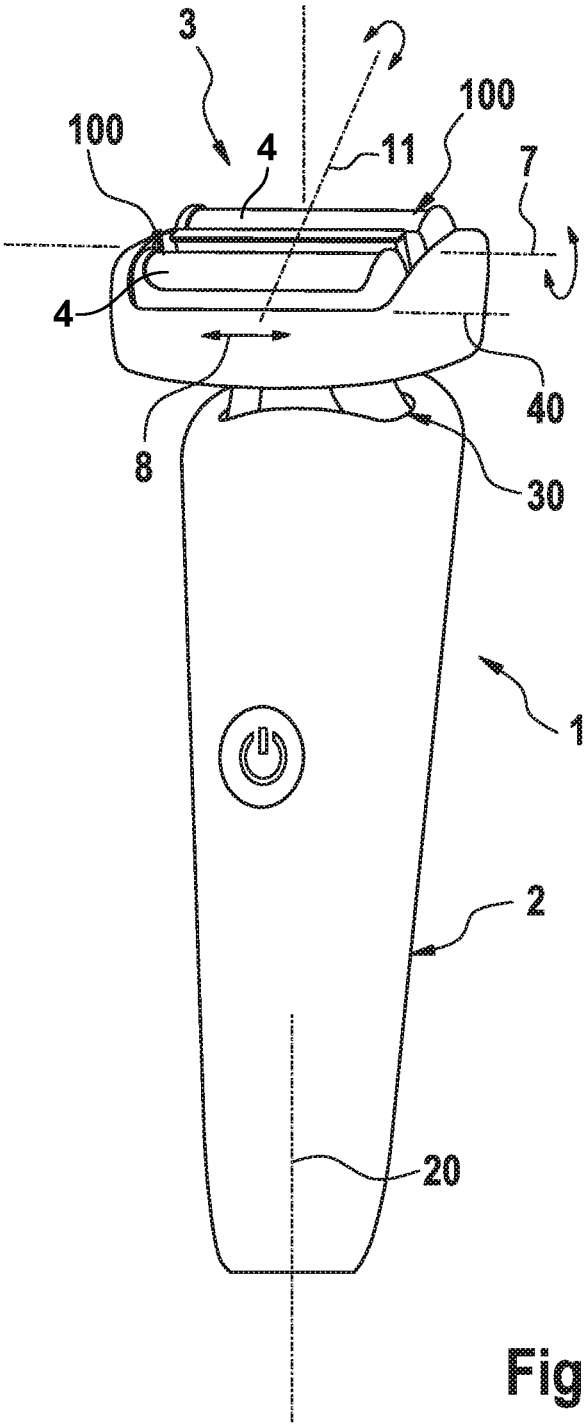
FIG. 1: a perspective view of an electric shaver with a shaver connected to a handle by means of a support structure.

According to an aspect, to achieve at least one of the aforementioned objectives, it is suggested to provide for a seal which does no longer form a separate element, but is an integral portion of one of the housing elements. More particularly, the cover element for closing the base element of the housing, and said at least one seal may form an integral one-piece structure so that the seal is automatically mounted when assembling the electric shaver, more particularly when assembling the housing elements to each other and/or said cover element to the connection, i.e., a shaft, extending from the housing's interior through said cover element to the working head of the device. According to an aspect, the seal is integrally molded onto said cover element so that said seal and said cover element form an integral one-piece structure made from a soft-material component forming the seal and a hard-material component forming the cover element. Using a two- or three components molding process for manufacturing the cover element together with the seal allows for easy manufacturing and precise positioning of the seal relative to the cover element and thus, relative to the housing.

The seal may be formed from silicone. The cover element and/or the base element of the housing may be formed from polybutylene terephthalate (PBT), wherein, however, other plastic materials or non-plastic materials may be used. The materials may be reinforced by fibers or other reinforcements.

More particularly, the aforementioned seal may comprise a first sealing element forming an axial seal sandwiched between the cover element and the base element of the housing under axial pressure substantially parallel to a longitudinal axis of the elongated housing. Such axial sealing element with axially exerted sealing forces allows for greater freedom in design of the interface between the cover element and the base element, but nevertheless provides for excellent sealing even when there are tolerances and/or variations in mounting forces.

Said first sealing element may contact a pair of sealing surfaces extending in planes inclined to the longitudinal axis of the elongated housing at an acute angle of less than 85° or less than 75° or ranging from 45° to 75°.

To achieve appropriate sealing forces for a wide range of mounting variations in terms of different degrees of compression, said first sealing element may form a cone-like or trumpet-like or mostly cylindrical sealing ring with a diameter expanding from one axial end of the sealing ring to another axial end thereof.

Advantageously, the sealing ring may expand towards its free, unfixed end. In other words, said sealing ring's end portion integrally molded onto the cover element may have a diameter smaller than the sealing ring's end portion contacting the base element of the housing. When projecting outwardly with its free end, ambient pressure applied onto the sealing ring may increase the sealing forces. The higher the outer pressure is, the firmer the sealing contact is.

In a kinematic reverse arrangement, the sealing element may be integrally molded onto the base element and, with its free end, contact the cover element in a sealing manner. Nevertheless, fixedly attaching the sealing element to the cover element may be advantageous as other sealing elements, for example for sealing the drive train, may be attached to the cover element as well, so a plurality of sealing elements may be provided on the same element, thereby making manufacturing more efficient.

More particularly, said first sealing element can be configured to provide for an axial sealing force substantially parallel to the longitudinal axis of the housing, which axial sealing force shows, at an initial stage of compression of the first sealing element, an increase significantly larger than an increase in axial sealing force at a second stage of compression of the first sealing element and/or which axial sealing force continuously increases with increase in compression of the first sealing element, wherein the increase in axial sealing force decreases with increasing compression.

Said first sealing element may form a cone-shaped sleeve expanding at an angle of 2× 30° to 2× 65°, when considering a non-compressed, non-deformed status of the sealing element. In addition or in the alternative, the cone-shaped sealing element may have a length ranging from 1 mm to 20 mm or from 3 mm to 15 mm or from 5 mm to 10 mm. A wall thickness of the first sealing element may range from 0.5 mm to 5 mm or from 1 mm to 3 mm.

According to a still further aspect, the seal may include a second sealing element forming a sleeve surrounding a rotatorily oscillating shaft extending through said cover element, wherein said sleeve-like second sealing element is, one end fixedly connected to the cover element and, at another end, fixedly connected to said shaft to oscillate therewith, wherein the second sealing element's middle portion is configured to twist and/or compensate an elastic stretch in the longitudinal direction caused by the rotatory oscillation of the shaft.

Said second sealing element may include said sealing sleeve and a sealing ring attached to an inner surface of said sealing sleeve and to an outer surface of said shaft, wherein said sealing ring is made from a hard-material component, whereas said sealing sleeve is made from a soft-material component.

More particularly, said sealing sleeve can be made from silicone and said sealing ring can be made from polyamide.

To allow for sufficient elasticity, but nevertheless avoid high losses in terms of torque and/or twisting forces, said middle portion of said sealing sleeve has a diameter ranging from 110% to 300% or 125% to 250% of the diameter of said shaft.

Furthermore, said middle portion of said sealing sleeve may have a wall thickness of less than 0.8 mm or less than 0.6 mm or less than 0.4 mm.

The above sealing structure may reveal additional advantages if the moving shaft to be sealed moves oscillating and/or rotatory and/or linearly pushing along the longitudinal shaft axis. The seal for sealing the housing at the opening through which the shaft extends, needs to be elastic and/or to allow said movement in all those directions, but nevertheless should prevent liquids or moisture from entering into the housing.

The housing may have a multi-shell structure comprising an inner housing in which the motor is received, and an outer housing surrounding said inner housing in a shell-like manner, wherein connector elements may be provided on the inner housing so as to support the shaver head. Although the housing includes an outer shell in terms of the aforementioned outer housing surrounding the inner housing, the support structure of the shaver head may be connected directly to the inner housing which supports the motor and the shaft which is connected to the motor and includes a shaft portion extending outside the housing towards the shaver head. Thus, the outer housing may be designed to meet users' tactile preferences without being restricted by the supporting function of the housing.

The inner housing may form a sealed, in particular water-proof container in which the motor, batteries or accumulators or other power sources and an electronic control unit for controlling the motor may be received and protected against liquids and moisture, wherein said container may have a barrel structure and being formed by an elongated pot or cup having a closed bottom and an open top side, wherein the motor, an electronic control unit and batteries may be completely received within such cup-shaped base element of the inner housing which, at its open top side, may be closed by means of a cover element which may form the front face of the barrel-like container forming the inner housing.

Thus, the barrel-like container forming the inner housing may have a two-piece structure comprising only two pieces, i.e. the aforementioned cup-shaped base element and the cover element. Such two-piece structure of the inner housing considerably reduces sealing efforts necessary to make the container waterproof. In particular, it may be sufficient to use only one ring-shaped seal to seal the interface between the cup-shaped base element and the cover element, wherein such interface may have a circular configuration although other contours such as oval or elliptical contours would be possible.

The aforementioned cup-shaped base element may have an elongated configuration extending substantially over the entire length of the inner housing and may have a length corresponding to at least 80% or 90% of the inner housing and/or of the handle, whereas the cover element may have a length of smaller than 20% or smaller than 10% of the inner housing's length and/or the handle's length. Such cover element may have a disk-like or plate like configuration, wherein it may have a slightly dome-shaped or convex contour.

The connector for connection to the shaver head's support structure may be provided on the aforementioned cover element.

The cover element and the cup-shaped base element of the inner housing may be rigidly connected to each other, wherein various known types of connection techniques such as form-fitting, screwing, welding, gluing and/or snap-fitting may be used.

So as to hold the motor and/or the electronic control unit and/or the batteries in position within the inner housing, a support frame to which the aforementioned components are attached, may be inserted into the cup-shaped base element and may be held there in place, wherein for example a slideable guide element such as a guiding groove and/or guiding projections may be provided. Such support frame may be formed by or include a circuit board forming part of the electronic control unit. The shaft for driving the cutter unit may be rotatably supported by a bearing or a plurality of bearings attached to and/or formed by the cup-shaped base element and/or the cover element of the inner housing.

So as to help in sealing the inner housing, the inner housing may have only one opening which may be an opening in the cover element through which the shaft protrudes. Optionally, there may be a second opening in an end portion opposite to the cover element which second opening may be provided for a charging connection. However, such second opening may be avoided by means of integrating the charging connectors into the inner housing, for example by means of molding charging pins to be an integral part of the inner housing. Further optionally a third opening is provided at the inner housing which is covered by a water impermeable but gas permeable material, as provided by a functional fabric like e.g. Gore-Tex®, for balancing gas pressure differences between the inside of the inner housing and the outside. Such pressure difference may be caused by the battery which is provided inside the inner housing.

So as to allow communication with the control unit inside the inner housing, the inner housing may include a soft material portion allowing to be deformed so as to activate switches positioned inside the inner housing. In addition or in the alternative, the inner housing may be provided with a display means for displaying information wherein such display element may be integrated into the inner housing by means of molding and/or form a part of the inner housing's surface.

So as to allow access to the aforementioned soft material portion associated with switching means of the inner housing, the outer housing also may have soft material portions and/or a recess or opening through which the soft material portion of the inner housing can be deformed. In addition or in the alternative, the outer housing may include a transparent portion covering the aforementioned display means of the inner housing so that such display means is visible through the transparent portion of the outer housing. In the alternative or in addition it also would be possible to provide the outer housing with a recess or opening through which the display can be seen. Said recess or opening may then be closed by said display or other closure means.

The outer housing may have a two-piece or three-piece or multiple-piece shell structure comprising a plurality of shell elements that can be connected with each other and cover different portions of the inner housing. In particular, the outer housing may comprise two shell elements extending on opposite sides of the inner housing and connectable to each other. Such shell elements may have a substantially—roughly speaking—flute-like or chute-like contour so that the two shell elements together may surround the inner housing substantially completely.

In addition to such shell elements, the outer housing may further include a ring element to be connected with at least one of the aforementioned shell elements. Such ring element may help in forming a rigid, strong outer housing structure, wherein such ring element may be positioned at an end portion of the housing facing the shaver head. More particularly, such ring element may surround the shaft and may have an inner diameter which is significantly smaller than the maximum diameter of the inner housing. Such a ring element may be provided in addition or in the alternative to a molded silicon sealing. With a combination of both, the ring element is designed to seal only and the molded silicone or soft material portion is provided to receive and compensate for deformational forces caused by the motor drive. Having a molded silicone or soft material portion only means that this may be designed to provide both functions: sealing to the outside and deformation through motor movements. Such a silicone-movement-sealing suffers from the effect that the deformation of itself may lower the sealing capability between motor drive and sealing.

In order to provide for an improved ergonomic handling of the shaver, the shaver head may have a functional surface inclined towards a front side of the handle at an acute angle to the longitudinal axis of the handle, wherein said acute angle may vary. For example, said acute angle may range from 45° to 85° or, for example, from 55° to 80°. Such inclination makes it easier to hold the shaver with said functional surface parallel to the skin to be shaved without angling the hand or the arm in a non-natural position. The aforementioned functional surface is the shaver head's surface where the at least one cutter unit is positioned, wherein, for example, a pair of such elongated cutter units may be positioned parallel to each other on such functional surface. Additional functional elements such as a long hair cutter and/or a cooling element and/or a lubrication element also may be positioned on such functional surface, wherein, for example, a long hair cutter may be positioned between a pair of cutting units or along a side thereof.

The aforementioned front side of the handle, towards which the shaver head, with its functional surface, is inclined, may be considered to be side of the handle which remains open or untouched when the handle is grabbed by hand and/or which faces the user grabbing and watching the shaver. Usually, at least one operating key such as an on/off key or switch may be positioned on such front side of the handle.

When considering the handle in its entirety, the handle may have an elongated shape the cross-section of which may substantially continuously increase from a bottom face of the handle to a top face of the handle opposite to said bottom face of the handle. In other words, the cross-section of the handle may continuously increase towards the shaver head. The cross-sectional shape may vary, wherein such cross-sectional shape may be substantially rounded and/or circular and/or elliptical and/or oval. "Substantially continuously" does not exclude some portions such as a display portion or an operating key portion where the cross-section does not increase. Nevertheless, when considering the larger proportions, the handle's cross-section may increase from a bottom end portion to a top end portion.

In addition, a drive transmitter may include a shaft or shaft-like elongated drive element extending from the handle into the interior of the shaver head.

So as to transform the rotatory oscillation of such shaft as mentioned before into a linear oscillation of at least one cutter element, a crank arm may be attached to the shaft, wherein such crank arm may be positioned within the shaver head and/or may support at least one drive pin for driving the cutter element. For example, such drive pin may extend substantially parallel to the shaft and may be fixedly attached to the crank arm to extend eccentric with regard to the shaft axis. When the crank arm, in its neutral position, extends substantially perpendicular to the desired linear oscillation of the cutter element, such drive pin is moved along a curved path tangential to the desired cutter element oscillation and thus, executes a nearly linear oscillation.

These and other features become more apparent from the examples shown in the drawings. As can be seen from FIG. 1, shaver 1 may have a shaver housing 300 forming a handle 2 for holding the shaver, which handle may have different shapes such as—roughly speaking—a substantially cylindrical shape or box shape or bone shape allowing for ergonomically grabbing or holding the shaver, wherein such shaver handle 2 has a longitudinal axis 20 due to the elongated shape of the handle, cf. FIG. 1.

More particularly, the handle 2 may have a cross-sectional shape which is rounded or circular or oval or elliptical, wherein mixtures of those shapes are possible. Irrespective of the cross-sectional shape, the cross-section may continuously increase from one end of the handle to the other one thereof.

On one end of the handle 2, a shaver head 3 is attached to the handle 2, wherein the shaver head 3 may be slewably supported about a swiveling axis 7 and about a tilting axis 11 which swiveling and tilting axes 7 and 11 may extend substantially perpendicular to each other and perpendicular to the aforementioned longitudinal handle axis 20.

When considering an oblong main axis 40 of the shaver head 3, the swivel axis 7 may extend parallel to such main axis 40, whereas the tilting axis 11 may extend perpendicular to such main axis 40. Such main axis 40 may be considered to extend in parallel to the larger side surfaces of the shaver head 3 and/or in parallel with a longitudinal axis of the elongated cutter elements 4 and/or in parallel with a cutter oscillation axis 8 and/or substantially perpendicular to the longitudinal handle axis 20.

The shaver head 3 may include a pair of elongated cutter units 100 each comprising an elongated cutter element (not shown) that can be driven in a reciprocating manner along reciprocating axis 8 which may extend parallel to the aforementioned main axis 40. Said cutter elements may cooperate with and reciprocate under shear foils 5 covering said cutter elements.

Figure 2:
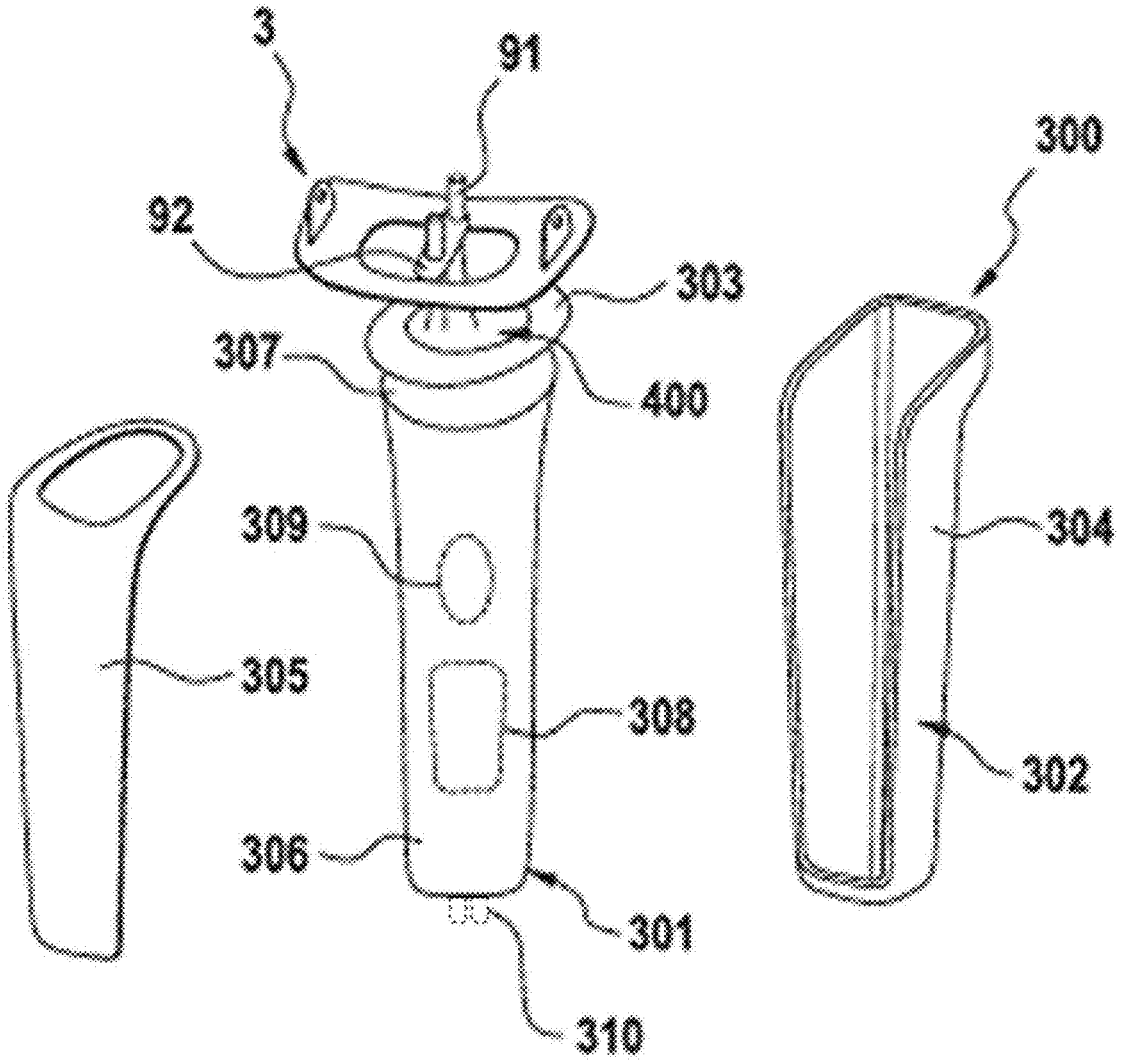
FIG. 2: a schematic explosion view of the housing of the electric shaver showing the shell-like structure of the housing including an outer housing and an inner housing having a seal integrally molded thereto.
Figure 3:
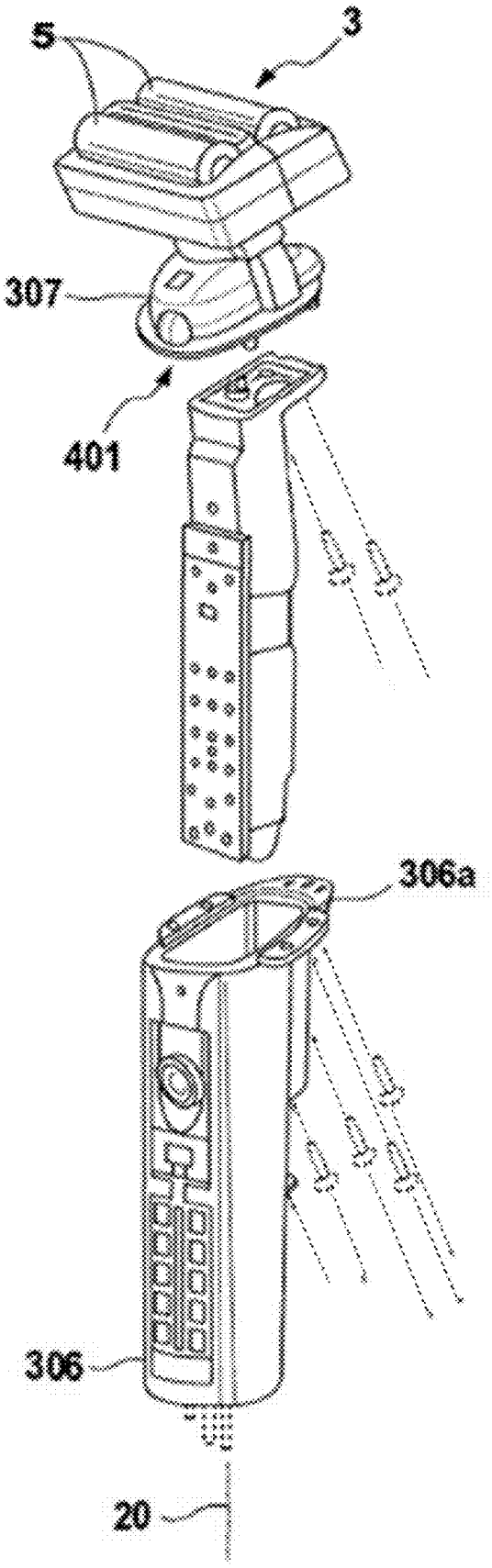
FIG. 3: a perspective, explosion view of the inner housing of FIG. 2, wherein the elongated, cup-shaped base element of the housing is shown apart from the cover element to allow assembling of the drive unit.

As can be seen from FIGS. 1 to 3, the shaver head 3 is supported onto the handle 2 by means of a support structure 30.

In addition to said support structure 30, an elongated drive transmitter may extend from the handle 2 into the shaver head 3 so as to connect the cutter element to a motor (not shown) which may be accommodated in the interior of the handle 2. Such elongated drive transmitter may include a shaft 90 which may be driven to rotate in a reciprocating manner, i.e. to rotate back and forth by a certain degree. A crank arm 92 may be rotatorily fixed to said shaft 90 and accommodated inside the shaver head 3. Such crank arm 92 may rigidly support a drive pin 91 for each of said cutter elements. Said crank arm 92, in a neutral position of the shaft 90 may extend transverse to the longitudinal axis of the elongated cutter element so that the drive pin 91 moves back and forth along the longitudinal axis of the cutter element. More particularly, such drive pin 91 executes a movement along a segment of a circle. However, as the rotational oscillation has a limited amplitude and the circular segment is tangential to the longitudinal axis of the cutter element, such movement may be considered to approximate a linear movement along the cutter element's longitudinal axis.

As can be seen from FIG. 2, the housing 300 forming the handle 2 may have a two-shell structure comprising an inner housing 301 and an outer housing 302 surrounding said inner housing 301.

The inner housing 301 accommodates the aforementioned motor and furthermore, an electrical power source (not shown) such as batteries or an accumulator, and an electronic control unit (not shown), cf. FIG. 3, wherein the inner housing 301 may form a water-tight container protecting such components from liquids and moisture.

More particularly, the inner housing 301 may have an elongated barrel-like structure including a cup-shaped or pot-like base element 306 having a closed bottom and an open top face, wherein such base element may extend substantially over the entire length of the handle 2, cf. FIGS. 2 and 3.

The base element 306 is closed, at its open top side, by a cover element 307 which may have a plate-like or slightly dome-like shape and, when closing the base element 306, forms a front face side of the inner housing 301 facing the shaver head 3.

The aforementioned cover element 307 includes an opening 312 (see FIG. 4) through which the shaft 90 penetrates the inner housing 301, wherein the cover element 307 is sealed, by means of appropriate seals 400, against said shaft 90 and against the cover element 307 so that the inner housing 301 forms a waterproof container.

Figure 4:
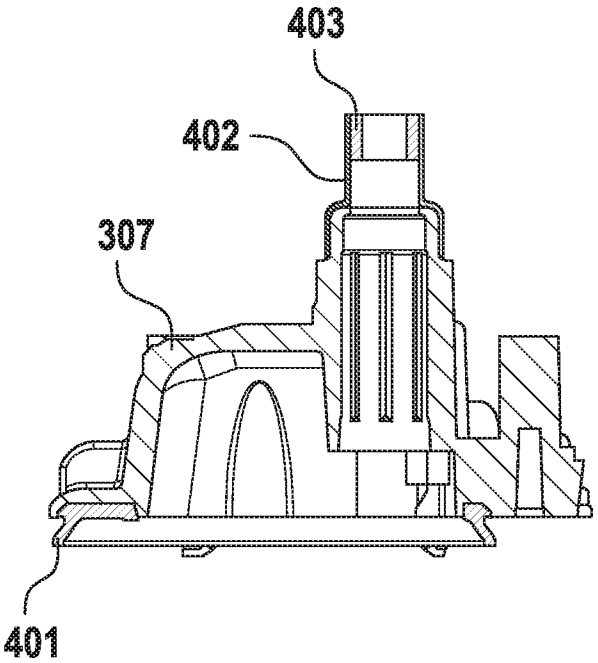
FIG. 4: a cross-sectional view of the cover element of the housing with the first and second seal elements integrally molded thereto, wherein partial view (a) shows the cover element with the oscillating shaft of the drive unit extending through the second seal element and partial view (b) shows the cover element without said shaft to show the structure of the second sealing element more clearly.
Figure 4:
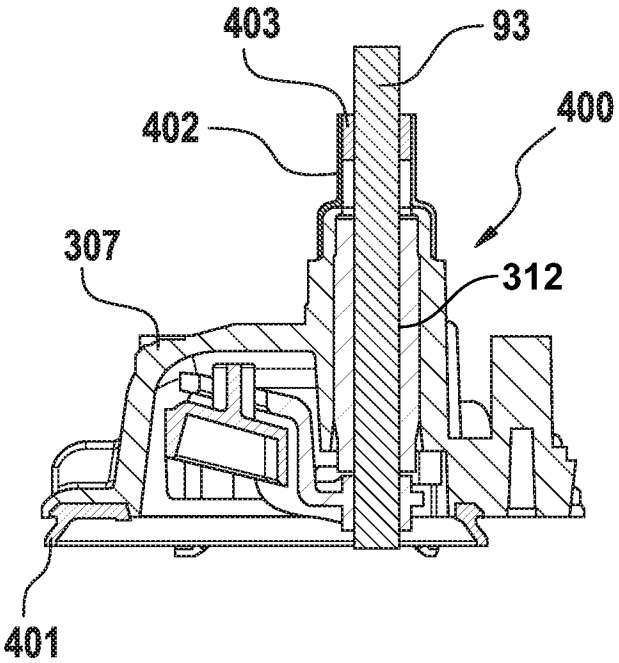
Figure 5:
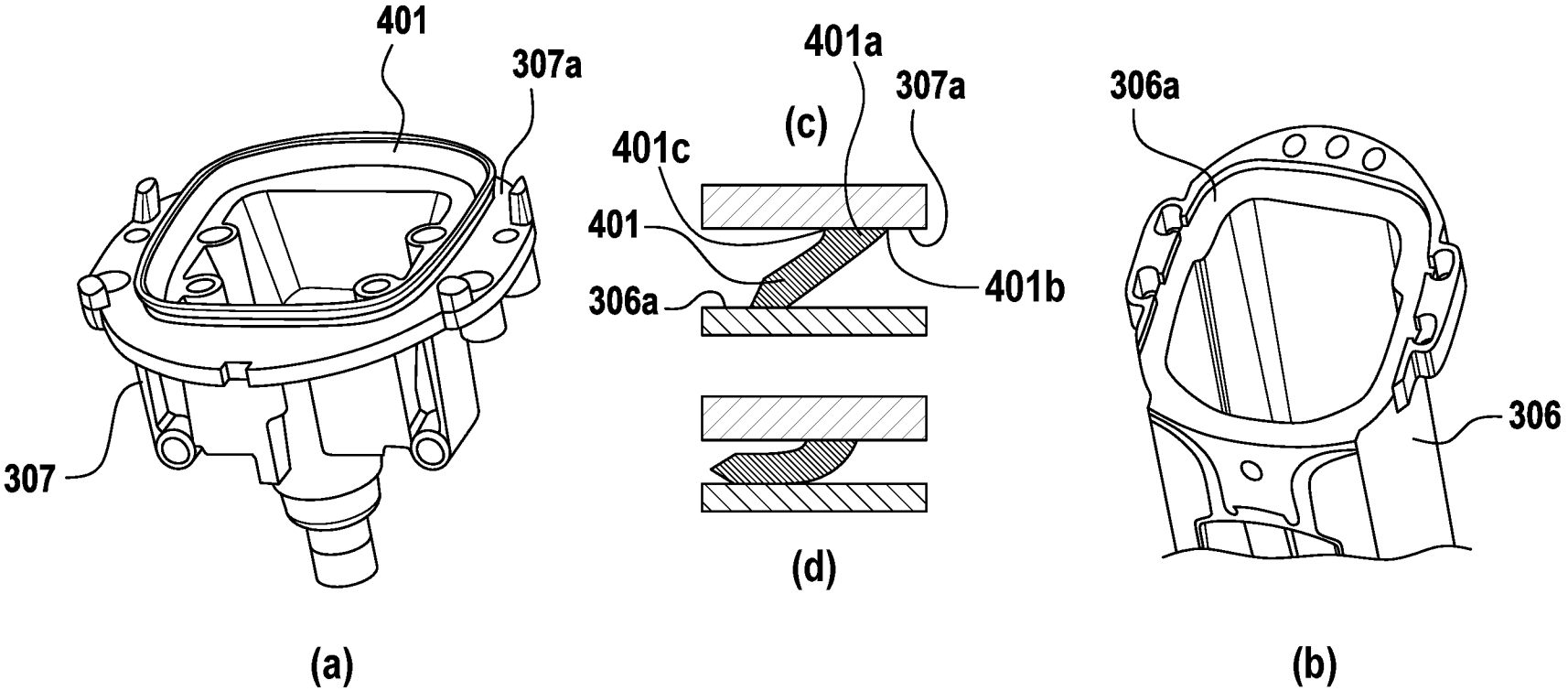
FIG. 5: a perspective view of the interface between the elongated base element of the housing and the cover element, wherein partial view (a) shows the cover element with the first sealing element integrally connected thereto, partial view (b) shows the end portion of the elongated base element with the end surface thereof forming the contact/sealing surface against which the elastic first sealing element of the cover element is pressed, partial view (c) shows an uncompressed lip-like first sealing element, and partial view (d) shows the deformation of the lip-like first sealing element due to the axial mounting movement when the cover element is axially mounted onto the base element.

As can be seen from FIGS. 4 and 5, said seal 400 may include a first sealing element 401 for sealing the connecting interface between the housing's base element 306 and the cover element 307, wherein said first sealing element 401 may form a ring-shaped sleeve sandwiched between a pair of end surfaces 306*a* and 307*a* of the base element and the cover element facing each other, so that the first sealing element 401 is axially compressed between said pair of end surfaces 306*a* and 307*a*. Thus, said first sealing element 401 forms an axial seal subject to axial sealing forces which are substantially parallel to the longitudinal axis 20 of the housing 300. When considering the upright position shown by FIGS. 1 and 3, the first sealing element 401 is subject to upright forces from above and from below.

More particularly, as can be seen from FIGS. 3 and 5, said pair of end surfaces 306*a* and 307*a* forming the sealing surfaces sealed by said sealing element 401, are arranged at an acute angle to and thus inclined to the longitudinal axis 20 of the housing 300. More particularly, said sealing surfaces 306*a* and 307*a* forming the connecting interface between the cover element 307 and the base element 306 extend substantially parallel to a plane which is inclined to said housing's longitudinal axis 20 at an acute angle of, e.g., 30°. Such inclined arrangement helps in assembling the drive transmitter into the cover element 307. As can be seen from FIG. 1 and FIG. 3, the shaver head 3 is tilted toward the front side of the housing 300 to achieve better ergonomical handling. Due to such tilted shaver head arrangement, the oscillating shaft 90 supporting the crank arm 92 and drive pins 91, cf. FIG. 2, is also tilted toward the front side of the shaver, so mounting of these components into the cover element 307 is easier when the aforementioned connecting interface is also tilted, i.e. inclined to the longitudinal axis 20 at an acute angle.

The aforementioned first sealing element 401 may form a cone-shaped or trumpet-shaped sleeve expanding outwardly at an angle of about 2× 30° to 2× 50°, cf. FIGS. 5(*c*) and 5(*d*), when being in an uncompressed, undeformed status. More particularly, the first sealing element 401 may be a sealing ring that has a fixedly attached end 401*a* that is connected to the cover element. The fixedly attached end 401*a* has an innermost edge 401*b* and an outermost edge 401*c*. The first sealing element 401 extends outward from the outermost edge 401*c* so that the free end of the sleeveshaped sealing element 401 has a diameter larger than the other end of the sleevelike element fixedly connected to the cover element 307.

As mentioned before, the sealing element 401 may be integrally molded onto the cover element 307 in a multi-component, preferably either a two- or three-component molding process wherein in a first molding process step, the cover element 307 may be molded from a hard-material component such as PBT, and wherein in a second molding step the sealing element 401 may be molded onto the cover element 307 from a soft-material component such as silicone.

When assembling the housing 300 in terms of axially attaching the cover element 307 onto the base element 306, the first sealing element 401 automatically gets into sealing contact with the base element 306. When the cover element 307 is axially moved onto the base element 306, the conical first sealing element 401 is deformed and compressed, as it is shown by FIGS. 5(*c*) and 5(*d*) (FIG. 5(*c*) shows uncompressed status and lower figure FIG. 5(*d*) shows the compressed end position sealing status). The free end of the conical sealing element is bent outwardly so that the axial extension of the sealing element 401 becomes smaller, cf. FIG. 5(*d*), wherein the axial sealing force is increased by the increased sealing length.

Figure 6:
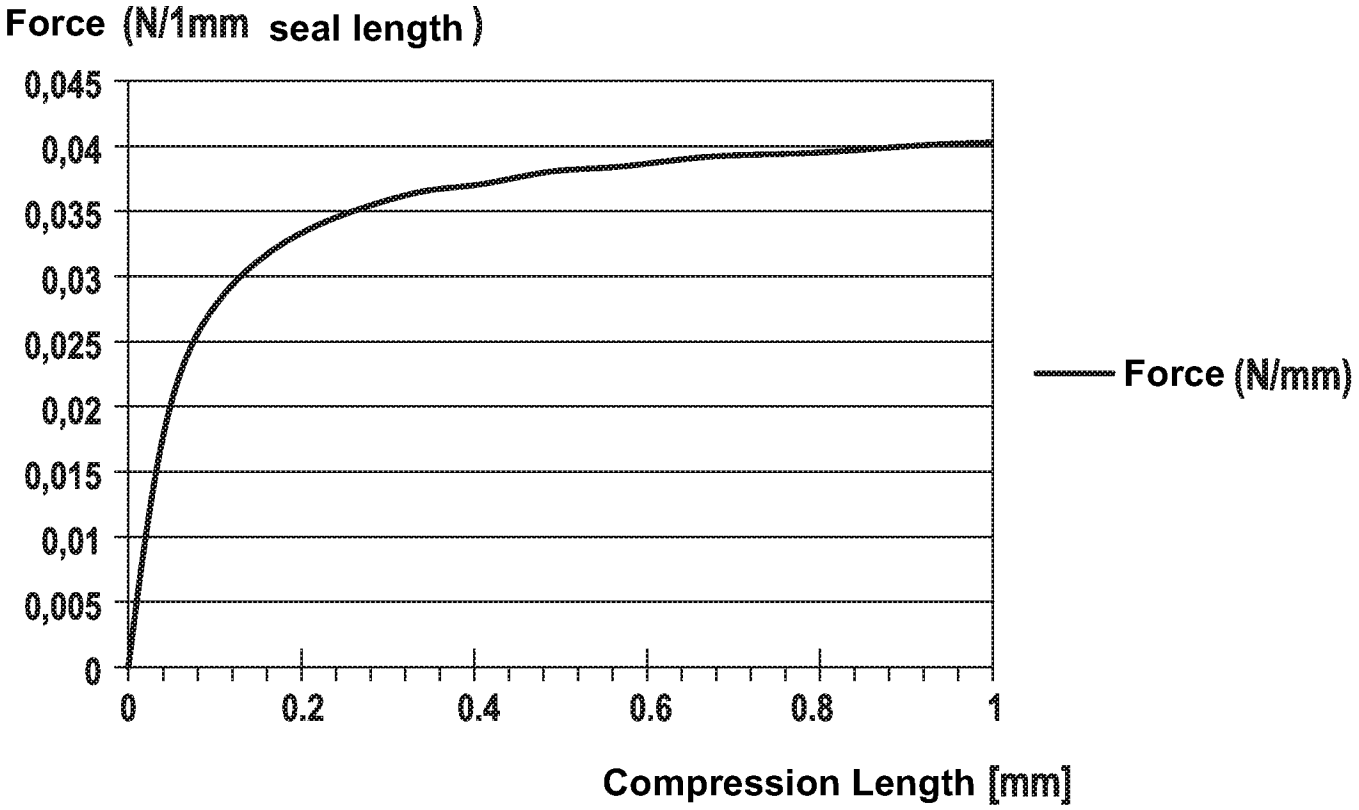
FIG. 6: shows the functional relation of the sealing force of the first sealing element relative to the axial compression of the first sealing element in a diagram-like illustration.

As illustrated by FIG. 6, the configuration of the first sealing element 401 provides for a sealing force showing only small changes over a rather large range of axial displacement. First, when the sealing element 401 gets into contact with the opposed sealing surface 306*a*, the axial sealing force increases rather steeply, cf. the left portion of FIG. 6. After such initial compression step, the rate of increase of the axial sealing force significantly decreases so as to provide a sealing force with only slight variations over a rather large compression displacement. In other words, the graph representing the functional relationship between sealing force and compression movement starts with a larger growth and then becomes gradually or continuously more flat, cf. FIG. 6. For example, in a compression range from 0.2 mm to 1 mm, the increase in axial sealing force may be less than 50% or less than 30% of the increase in axial sealing force in the initial compression range from 0 mm to 0.2 mm.

Figure 7:
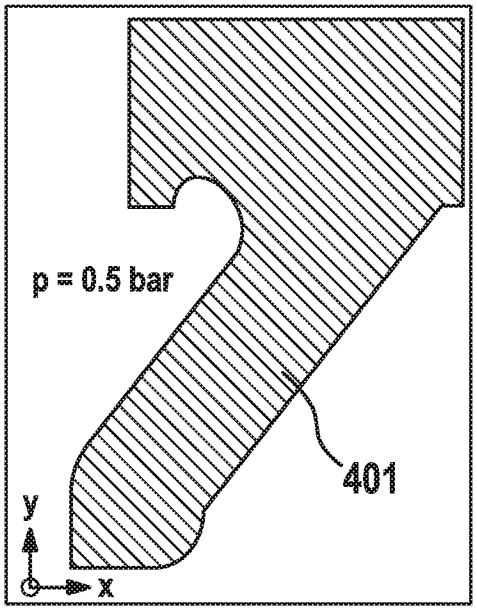
FIG. 7: a schematic illustration of the increase in sealing force due to increasing ambient pressure onto the first sealing element, wherein partial view (a) shows a diagram-like illustration of the compression force relative to the compression of the first sealing element similar to FIG. 6, wherein curve A-B illustrates the increase in sealing force due to ambient pressure, and partial view (b) illustrates the ambient pressure onto the first sealing element.
Figure 7:
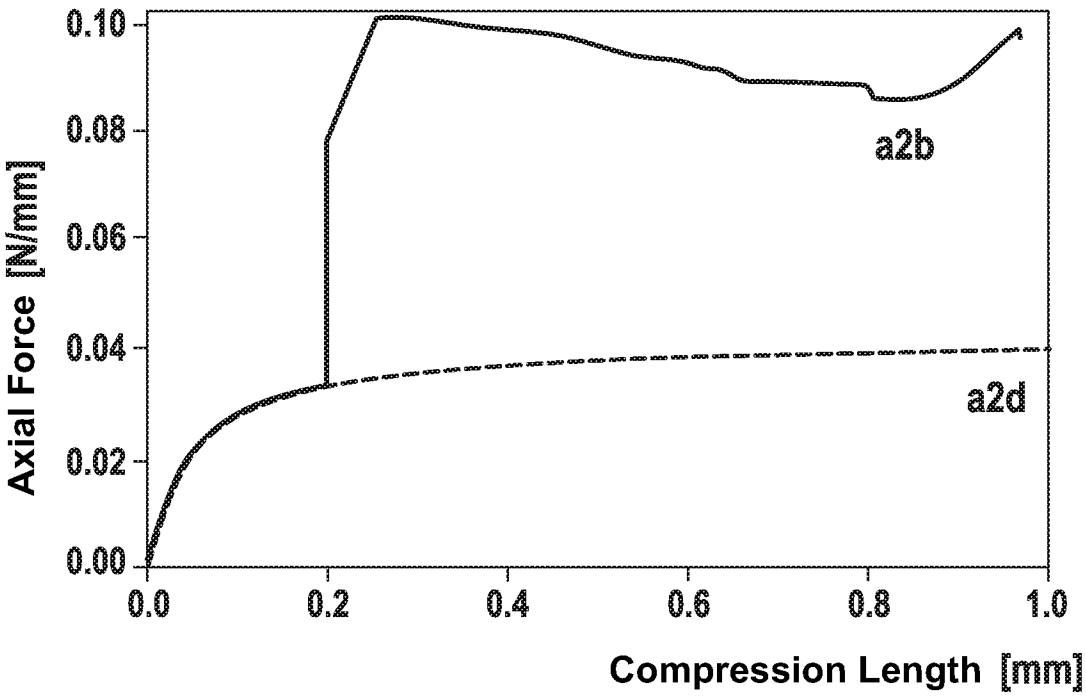

As the first sealing element 401 expands outwardly with its free end, the ambient pressure may help in increasing the sealing force as is illustrated by FIG. 7. Due to the inclined, outwardly expanding configuration of the first sealing element as shown by FIG. 7(*b*) and also FIG. 5(*c*), ambient pressure applied to the outer surface of the sealing element 401 urges the sealing element with an increased force against the sealing surface 306*a*. This effect is illustrated by FIG. 7(*a*) where the normal relation between sealing force and compression movement is illustrated by line a2*d* (no ambient pressure), whereas the line a2*b* illustrates the said relation for ambient pressure additionally applied to the outer surface of the sealing element 401, as shown by FIG. 7(*b*).

As shown by FIG. 4, the seal 400 further includes a second sealing element 402 for sealing the cover element 307 relative to the shaft 90 penetrating said cover element 307 which has an opening 312 through which said shaft 90 may extend.

Said second sealing element 402 may include a sealing sleeve or hose-like sealing element surrounding the shaft 90, wherein a first end portion of said sealing sleeve is fixedly attached to the cover element 307, whereas the other, opposite end portion of the sealing sleeve is fixedly attached to the rotatorily oscillating shaft 90. More particularly, said second end portion of the sleeve-like sealing element 402 may be fixedly attached to a sealing ring 403 which may be made from polyamide. Said sealing ring 403 is rotatorily fixed onto the shaft 90 to rotatorily oscillate therewith.

A middle portion of said second sealing element 402 extends spaced apart from the outer surface of said shaft 90 so that the middle portion may twist to compensate for the rotatory oscillation of the shaft 90. Said middle portion of the second sealing element 402 may have a cylindrical or at least substantially cylindrical shape, wherein other shapes such as slightly conical may be provided for. In addition or in the alternative, said middle portion of the second sealing element 402 may have the dimensions as mentioned above.

Also said second sealing element 402 may be integrally molded onto the cover element 307 in a two-component molding process, wherein said second sealing element 402 also may be made from silicone or another soft-material component molded onto the hard-material component forming the cover element 307.

As can be seen from FIG. 2, charging connections such as charging pins 310 may protrude from an opening (not visible) in the bottom side of the base element 306 so as to allow charging of the electric power source, i.e., batteries, inside the inner housing 301.

The inner housing 301 may include at least one soft material portion 309 which can be associated with an electronic switching means inside the inner housing 301. In addition or in the alternative, the inner housing 301 may be provided with a display element 308 which may include light sources such as LEDs to display information, wherein such display element 308 may be controlled by the electronic control unit.

As can be seen from FIG. 2, the outer housing 302 may have a shell structure including a pair of elongated shell elements 304 and 305 which together may surround the inner housing 301 substantially entirely. The shell elements 304 and 305 may extend substantially over the entire length of the inner housing 301 and/or the handle 2.

Said shell elements 304 and 305 may be positioned on opposite sides of the inner housing 301 and may be connected to each other so that they together form the gripping surface of the substantially cone-shaped or cylindrical handle 2.

In addition, the outer housing 302 may include a ring element 303 forming, at least in part, a top side surface of the outer housing 302 facing the shaver head 3, wherein said ring element 303 may have an inner diameter substantially smaller than the maximum outer diameter of the inner housing 301. Said ring element 303 is connected to at least one of the shell elements 304 and 305 and may cover a ring-shaped portion of the cover element 307 of the inner housing 301.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

The invention claimed is:

1. An electric shaver, comprising:

an elongated inner housing comprising a base element, a first sealing element, a second sealing element, and a cover element closing said base element;

an outer housing surrounding said inner housing;

a shaver head attached to said inner housing; and a driven shaft extending through an opening in said cover element and rotatorily oscillating about a longitudinal axis of said driven shaft;

wherein said base element comprises a first end surface and said cover element comprises a second end surface, said first and second end surfaces defining an interface between said base and cover elements;

wherein said cover element is sealed to said base element by said first sealing element and to said driven shaft by said second sealing element;

wherein said first and second sealing elements are integrally molded onto said cover element;

wherein said first sealing element forms a sealing ring disposed in said interface that forms an axial seal between said cover element and said base element, wherein said sealing ring comprises a fixedly attached end that is fixedly attached to said cover element and a free end, wherein said sealing ring forms a cone shape with a diameter expanding from said fixedly attached end to an outermost portion of said free end; and wherein said second sealing element comprises a sealing sleeve, wherein said sealing sleeve is fixedly attached to said cover element at a first end portion of said sealing sleeve and is fixedly attached to said driven shaft at a second end portion of said sealing sleeve to rotatorily oscillate together with said driven shaft, wherein a middle portion of said sealing sleeve is elastically twistable to compensate for rotatory oscillation of said driven shaft relative to said cover element, and wherein said sealing sleeve extends outwardly from said cover element such that said second end portion is spaced apart from said first end portion along said driven shaft.

2. The electric shaver according to claim 1, further comprising a second sealing ring at the second end portion of said sealing sleeve, wherein said second sealing ring is made from a hard-material component and said sealing sleeve is made from a soft-material component.

3. The electric shaver according to claim 2, wherein said second sealing ring is made from polyamide and said sealing sleeve is made from silicone.

4. The electric shaver according to claim 1, wherein said middle portion of said sealing sleeve has a diameter ranging from 110% to 300% of a diameter of said shaft.

5. The electric shaver according to claim 1, wherein said middle portion of said sealing sleeve has a wall thickness of less than 0.8 mm.

6. The electric shaver according to claim 1, wherein said inner housing forms a sealed container, said sealed container having a barrel structure and being formed by said base element and said cover element surrounding said shaft and closing said base element, wherein said base element has a length of at least 90% of an entire length of said inner housing.

* * * * *